US008820954B2

(12) United States Patent
Horn et al.

(10) Patent No.: US 8,820,954 B2
(45) Date of Patent: Sep. 2, 2014

(54) LIQUID DISPLACER IN LED BULBS

(75) Inventors: David Horn, Saratoga, CA (US); Christopher R. Moylan, Sunnyvale, CA (US); Glenn Wheelock, San Jose, CA (US)

(73) Assignee: Switch Bulb Company, Inc., San Jose, CA (US)

( * ) Notice: Subject to any disclaimer, the term of this patent is extended or adjusted under 35 U.S.C. 154(b) by 26 days.

(21) Appl. No.: 13/556,141

(22) Filed: Jul. 23, 2012

(65) Prior Publication Data

US 2012/0287608 A1 Nov. 15, 2012

Related U.S. Application Data

(63) Continuation of application No. 13/038,302, filed on Mar. 1, 2011, now Pat. No. 8,226,274.

(51) Int. Cl.
*F21V 29/00* (2006.01)
*F21V 7/00* (2006.01)

(52) U.S. Cl.
USPC ..... 362/101; 362/294; 362/373

(58) Field of Classification Search
USPC ..... 362/294, 373, 101, 96, 580, 547, 126, 362/218, 264, 345, 800
See application file for complete search history.

(56) References Cited

U.S. PATENT DOCUMENTS

| | | | |
|---|---|---|---|
| 2,980,547 | A | 4/1961 | D'Adrian |
| 3,293,051 | A | 12/1966 | Searight et al. |
| 3,330,981 | A | 7/1967 | Aia |
| 3,560,074 | A | 2/1971 | Searight et al. |
| 4,170,035 | A | 10/1979 | Walker |
| 4,271,458 | A | 6/1981 | George, Jr. |
| 4,675,575 | A | 6/1987 | Smith et al. |
| 5,890,794 | A | 4/1999 | Abtahi et al. |
| 6,059,676 | A | 5/2000 | Seymour et al. |
| 6,254,939 | B1 | 7/2001 | Cowan et al. |
| 6,504,301 | B1 | 1/2003 | Lowery |
| 6,582,100 | B1 | 6/2003 | Hochstein et al. |
| 6,612,712 | B2 | 9/2003 | Nepil |

(Continued)

FOREIGN PATENT DOCUMENTS

| | | | |
|---|---|---|---|
| EP | 0658933 | B1 | 10/2001 |
| JP | 7-99372 | A | 4/1995 |

(Continued)

OTHER PUBLICATIONS

Non Final Office Action received for U.S. Appl. No. 13/070,309, mailed on Dec. 12, 2011, 11 pages.

(Continued)

*Primary Examiner* — Bao Q Truong
(74) *Attorney, Agent, or Firm* — Morrison & Foerster LLP

(57) ABSTRACT

An LED bulb includes at least one LED mount disposed within a shell. At least one LED is attached to the at least one LED mount. A thermally conductive liquid is held within the shell. The LED and LED mount are immersed in the thermally conductive liquid. A liquid displacer is immersed in the thermally conductive liquid. The liquid displacer is configured to displace a predetermined amount of the thermally conductive liquid to reduce the amount of thermally conductive liquid held within the shell. The liquid displacer is also configured to be compressible, where the liquid displacer is compressed in response to expansion of the thermally conductive liquid.

8 Claims, 7 Drawing Sheets

(56) References Cited

U.S. PATENT DOCUMENTS

| | | | | |
|---|---|---|---|---|
| 6,639,360 | B2 | 10/2003 | Roberts et al. | |
| 6,791,259 | B1 | 9/2004 | Stokes et al. | |
| 6,793,374 | B2 | 9/2004 | Begemann | |
| 6,948,829 | B2 | 9/2005 | Verdes et al. | |
| 7,075,112 | B2 | 7/2006 | Roberts et al. | |
| 7,078,732 | B1 | 7/2006 | Reeh et al. | |
| 7,213,934 | B2 | 5/2007 | Zarian et al. | |
| 7,288,798 | B2 | 10/2007 | Chang et al. | |
| 7,319,293 | B2 | 1/2008 | Maxik | |
| 7,344,279 | B2 | 3/2008 | Mueller et al. | |
| 7,396,146 | B2 | 7/2008 | Wang | |
| 7,413,326 | B2 | 8/2008 | Tain et al. | |
| 7,489,031 | B2 | 2/2009 | Roberts et al. | |
| 7,553,047 | B2 | 6/2009 | Shin et al. | |
| 7,575,333 | B2 | 8/2009 | Julia Vilarrasa | |
| 7,722,211 | B2 | 5/2010 | Marra et al. | |
| 8,152,341 | B2 * | 4/2012 | Wheelock et al. | 362/373 |
| 8,226,274 | B2 * | 7/2012 | Horn et al. | 362/294 |
| 2002/0149312 | A1 | 10/2002 | Roberts et al. | |
| 2003/0196357 | A1 | 10/2003 | Knapp et al. | |
| 2004/0004435 | A1 | 1/2004 | Hsu | |
| 2004/0113549 | A1 | 6/2004 | Roberts et al. | |
| 2004/0264192 | A1 | 12/2004 | Nagata et al. | |
| 2005/0063185 | A1 | 3/2005 | Monjo et al. | |
| 2005/0084229 | A1 | 4/2005 | Babbitt et al. | |
| 2005/0179379 | A1 | 8/2005 | Kim | |
| 2005/0224829 | A1 | 10/2005 | Negley et al. | |
| 2005/0243539 | A1 | 11/2005 | Evans et al. | |
| 2005/0243552 | A1 | 11/2005 | Maxik | |
| 2005/0270780 | A1 | 12/2005 | Zhang | |
| 2005/0276053 | A1 | 12/2005 | Nortrup et al. | |
| 2006/0002110 | A1 | 1/2006 | Dowling et al. | |
| 2006/0145172 | A1 | 7/2006 | Su et al. | |
| 2006/0176699 | A1 | 8/2006 | Crunk | |
| 2006/0187653 | A1 | 8/2006 | Olsson et al. | |
| 2006/0274524 | A1 | 12/2006 | Chang et al. | |
| 2006/0274797 | A1 | 12/2006 | Myers et al. | |
| 2007/0086189 | A1 | 4/2007 | Raos et al. | |
| 2007/0090391 | A1 | 4/2007 | Diamantidis | |
| 2007/0090737 | A1 | 4/2007 | Hu et al. | |
| 2007/0097692 | A1 | 5/2007 | Suehiro et al. | |
| 2007/0120879 | A1 | 5/2007 | Kanade et al. | |
| 2007/0246722 | A1 | 10/2007 | Ng | |
| 2007/0267976 | A1 | 11/2007 | Bohler et al. | |
| 2007/0291482 | A1 | 12/2007 | Baroky et al. | |
| 2007/0291490 | A1 | 12/2007 | Tajul et al. | |
| 2008/0013316 | A1 | 1/2008 | Chiang | |
| 2008/0094835 | A1 | 4/2008 | Marra et al. | |
| 2008/0219007 | A1 | 9/2008 | Heffington et al. | |
| 2009/0001372 | A1 | 1/2009 | Arik et al. | |
| 2009/0001390 | A1 | 1/2009 | Yan et al. | |
| 2009/0052187 | A1 | 2/2009 | Li | |
| 2010/0170670 | A1 | 7/2010 | Catalano | |
| 2010/0265717 | A1 | 10/2010 | Luettgens et al. | |
| 2011/0050073 | A1 | 3/2011 | Huang | |
| 2011/0050098 | A1 | 3/2011 | Lenk et al. | |
| 2011/0261563 | A1 | 10/2011 | Li | |
| 2011/0267805 | A1 | 11/2011 | Hua et al. | |
| 2012/0033440 | A1 * | 2/2012 | Wheelock et al. | 362/555 |

FOREIGN PATENT DOCUMENTS

| | | | |
|---|---|---|---|
| JP | 3351103 | B2 | 9/2002 |
| WO | 02/061805 | A2 | 8/2002 |
| WO | 2005/060309 | A2 | 6/2005 |
| WO | 2007/069119 | A1 | 6/2007 |

OTHER PUBLICATIONS

Non Final Office Action received for U.S. Appl. No. 12/663,697, mailed on Mar. 30, 2012, 16 pages.

Notice of Allowance received for U.S. Appl. No. 13/070,309, mailed on Jun. 22, 2012, 7 pages.

International Preliminary Report on Patentability received for PCT Patent Application No. PCT/US2008/065158, mailed on Dec. 11, 2009, 11 pages.

International Search Report and Written Opinion received for PCT Patent Application No. PCT/US2008/065158, mailed on Aug. 26, 2008, 11 pages.

International Search Report and Written Opinion received for PCT Patent Application No. PCT/US2012/027347, mailed on Jul. 11, 2012, 10 pages.

International Search Report and Written Opinion received for PCT Patent Application No. PCT/US2012/030177, mailed on Jul. 11, 2012, 9 pages.

Potter Industries Inc., "Material Safety Data Sheet (MSDS) for Sphericel Hollow Glass Spheres", prepared on Jan. 17, 2007, 4 pages.

Solids and Metals Specific, Gravities, "Specific Gravity for Some Common Solids and Metals as Aluminum, Asbestos, Brass, Calcium and Many Others", retrieved on Jun. 22, 2012, 10 pages, available online at: <http://www.engineeringtoolbox.com/specific-gravity-solids-metals-<C293.html>.

Specific Gravity Liquids, "Specific Gravity of Some Common Liquids and Fluids as Alcohol, Oils, Benzene, Water and Many More", retrieved on Jun. 22, 2012, 6 pages, available online at: <http://www.engineeringtoolbox.com/specific-gravity-liquids-d_336.html>.

Notice of Allowance received for U.S. Appl. No. 13/038,302, mailed on Jan. 11, 2012, 8 pages.

* cited by examiner

LIQUID DISPLACER IN LED BULBS

CROSS REFERENCE TO RELATED APPLICATION

The present application is a Continuation of U.S. patent application Ser. No. 13/038,302, titled LIQUID DISPLACER IN LED BULBS, filed Mar. 1, 2011, which issued as U.S. Pat. No. 8,226,274, on Jul. 24, 2012, which is incorporated herein by reference in its entirety for all purposes.

BACKGROUND

1. Field

The present disclosure relates generally to liquid-filled light-emitting diode (LED) bulbs, and more specifically to a liquid displacer in liquid-filled LED bulbs.

2. Related Art

Traditionally, lighting has been generated using fluorescent and incandescent light bulbs. While both types of light bulbs have been reliably used, each suffers from certain drawbacks. For instance, incandescent bulbs tend to be inefficient, using only 2-3% of their power to produce light, while the remaining 97-98% of their power is lost as heat. Fluorescent bulbs, while more efficient than incandescent bulbs, do not produce the same warm light as that generated by incandescent bulbs. Additionally, there are health and environmental concerns regarding the mercury contained in fluorescent bulbs.

Thus, an alternative light source is desired. One such alternative is a bulb utilizing an LED. An LED comprises a semiconductor junction that emits light due to an electrical current flowing through the junction. Compared to a traditional incandescent bulb, an LED bulb is capable of producing more light using the same amount of power. Additionally, the operational life of an LED bulb is orders of magnitude longer than that of an incandescent bulb, for example, 10,000-100,000 hours as opposed to 1,000-2,000 hours.

While there are many advantages to using an LED bulb rather than an incandescent or fluorescent bulb, LEDs have a number of drawbacks that have prevented them from being as widely adopted as incandescent and fluorescent replacements. One drawback is that an LED, being a semiconductor, generally cannot be allowed to get hotter than approximately 120° C. As an example, A-type LED bulbs have been limited to very low power (i.e., less than approximately 8 W), producing insufficient illumination for incandescent or fluorescent replacements.

One approach to alleviating the heat problem of LED bulbs is to fill an LED bulb with a thermally conductive liquid, to transfer heat from the LEDs to the bulb's shell. The heat may then be transferred from the shell out into the air surrounding the bulb. The thermally conductive liquid, however, contributes to the LED bulb's weight. Also, as heat is transferred from the LED to the conductive liquid, the temperature of the liquid increases, resulting in an increase in the liquid volume due to thermal expansion.

SUMMARY

In one exemplary embodiment, an LED bulb includes at least one LED mount disposed within a shell. At least one LED is attached to the at least one LED mount. A thermally conductive liquid is held within the shell. The LED and LED mount are immersed in the thermally conductive liquid. A liquid displacer is immersed in the thermally conductive liquid. The liquid displacer is configured to displace a predetermined amount of the thermally conductive liquid to reduce the amount of thermally conductive liquid held within the shell. The liquid displacer is also configured to be compressible, where the liquid displacer is compressed in response to expansion of the thermally conductive liquid.

DETAILED DESCRIPTION

The following description is presented to enable a person of ordinary skill in the art to make and use the various embodiments. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of the various embodiments. Thus, the various embodiments are not intended to be limited to the examples described herein and shown, but are to be accorded the scope consistent with the claims.

Various embodiments are described below relating to LED bulbs. As used herein, an "LED bulb" refers to any light-generating device (e.g., a lamp) in which at least one LED is used to generate light. Thus, as used herein, an "LED bulb" does not include a light-generating device in which a filament is used to generate the light, such as a conventional incandescent light bulb. It should be recognized that the LED bulb may have various shapes in addition to the bulb-like A-type shape of a conventional incandescent light bulb. For example, the bulb may have a tubular shape, a globe shape, or the like. The LED bulb of the present disclosure may further include any type of connector; for example, a screw-in base, a dual-prong connector, a standard two- or three-prong wall outlet plug, bayonet base, Edison Screw base, single-pin base, multiple-pin base, recessed base, flanged base, grooved base, side base, or the like.

As used herein, the term "liquid" refers to a substance capable of flowing. Also, the substance used as the thermally conductive liquid is a liquid or at the liquid state within, at least, the operating ambient temperature range of the bulb. An exemplary temperature range includes temperatures between −40° C. to +40° C. Also, as used herein, "passive convective flow" refers to the circulation of a liquid without the aid of a fan or other mechanical devices driving the flow of the thermally conductive liquid.

Figure 1A:
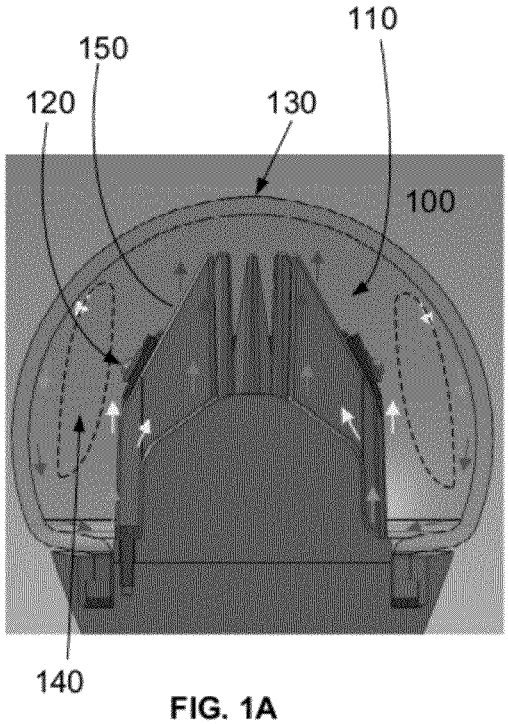
FIGS. 1A-1C depict passive convective flow within an exemplary LED bulb positioned upright, side ways, and upside down, respectively.
Figure 1B:
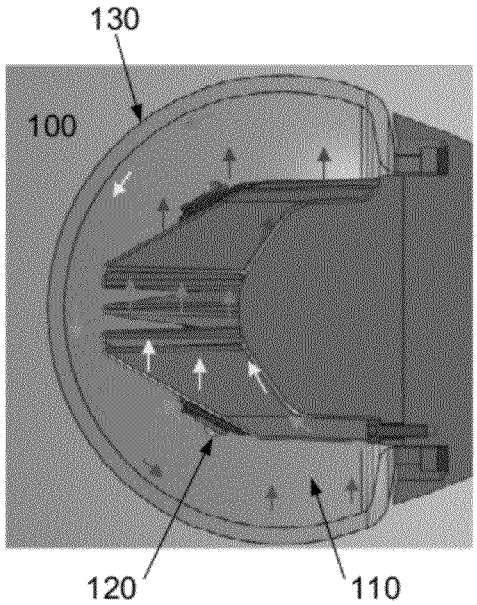
Figure 1C:
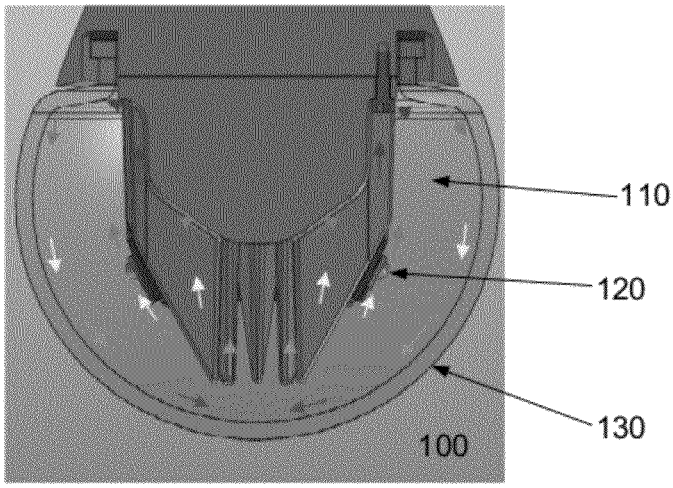

FIGS. 1A-1C depict an exemplary LED bulb 100. LED bulb 100 includes a shell 130 forming an enclosed volume over one or more LEDs 120. Shell 130 may be made from any transparent or translucent material such as plastic, glass, polycarbonate, or the like. Shell 130 may include dispersion material spread throughout the shell to disperse light generated by LEDs 120. The dispersion material prevents LED bulb 100 from appearing to have one or more point sources of light.

In some embodiments, LED bulb 100 may use 6 W or more of electrical power to produce light equivalent to a 40 W incandescent bulb. In some embodiments, LED bulb 100 may use 20 W or more to produce light equivalent to or greater than a 75 W incandescent bulb. Depending on the efficiency of the LED bulb 100, between 4 W and 16 W of heat energy may be produced when the LED bulb 100 is illuminated.

For convenience, all examples provided in the present disclosure describe and show LED bulb 100 being a standard A-type form factor bulb. However, as mentioned above, it should be appreciated that the present disclosure may be applied to LED bulbs having any shape, such as a tubular bulb, a globe-shaped bulb, or the like.

As shown in FIGS. 1A-1C, LEDs 120 are attached to LED mounts 150. LED mounts 150 may be made of any thermally conductive material, such as aluminum, copper, brass, magnesium, zinc, or the like. Since LED mounts 150 are formed of a thermally conductive material, heat generated by LEDs 120 may be conductively transferred to LED mounts 150. Thus, LED mounts 150 may act as a heat-sink or heat-spreader for LEDs 120.

LED bulb 100 is filled with thermally conductive liquid 110 for transferring heat generated by LEDs 120 to shell 130. The thermally conductive liquid 110 may be mineral oil, silicone oil, glycols (PAGs), fluorocarbons, or other material capable of flowing. It may be desirable to have the liquid chosen be a non-corrosive dielectric. Selecting such a liquid can reduce the likelihood that the liquid will cause electrical shorts and reduce damage done to the components of LED bulb 100. Also, it may be desirable for thermally conductive liquid 110 to have a large coefficient of thermal expansion to facilitate passive convective flow.

As depicted by the arrows in FIGS. 1A-1C, heat is transferred away from LEDs 120 in LED bulb 100 via passive convective flows. In particular, cells of liquid surrounding LEDs 120 absorb heat, become less dense due to the temperature increase, and rise upwards. Once the cells of liquid discharge the heat at the top and cool down, they become denser and descend to the bottom.

As also depicted by the arrows in FIGS. 1A-1C, the motion of the cells of liquid may be further distinguished by zones with cells of liquid that are moving in the same direction, and dead zones 140, i.e., zones between cells of liquid that are moving in opposite directions. Within a dead zone 140, the shear force between cells of liquid moving in one direction and cells of liquid moving in the opposite direction slows the convective flow of liquid within the dead zone 140, such that liquid in dead zones 140 may not significantly participate in the convective flow nor efficiently carry heat away from the LEDs 120. Thermally conductive liquid in dead zones 140, however, contributes to the LED bulb's overall weight. Additionally, the thermal expansion of the thermally conductive liquid within the dead zones 140, as the LED bulb's temperature increases from room temperature (e.g., between 20-30 Celsius) to an operating temperature (e.g., between 70-90 Celsius), should be accommodated.

Figure 2A:
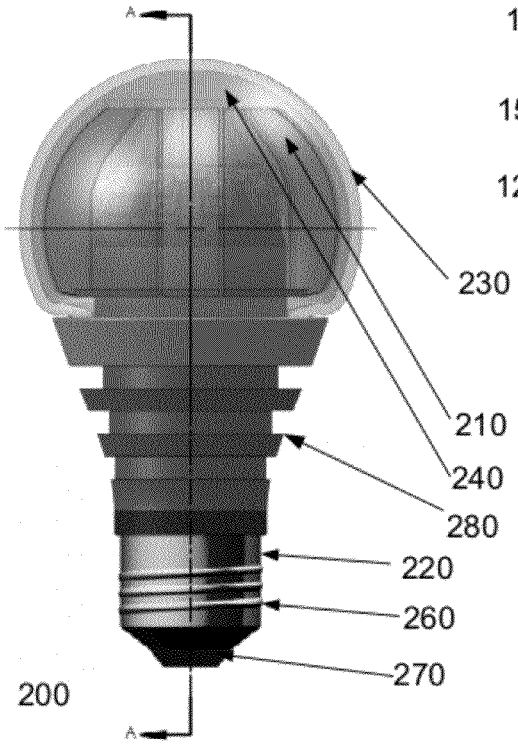
FIGS. 2A-2C depict an exemplary liquid displacer disposed within an exemplary LED bulb.
Figure 2B:
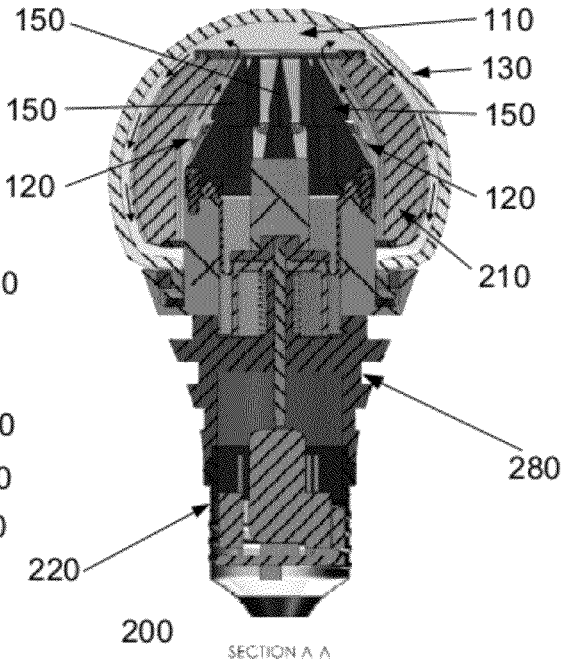
Figure 2C:
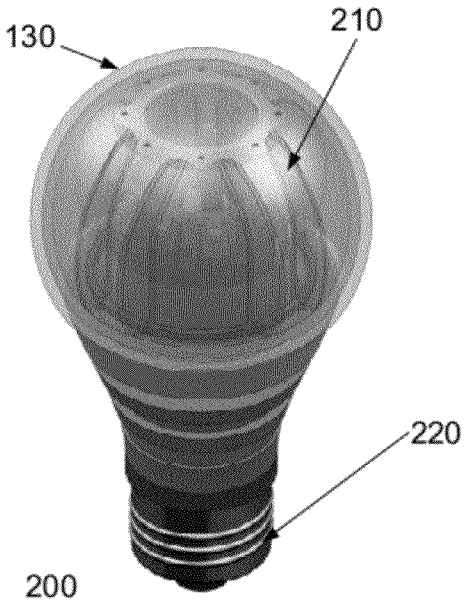

FIGS. 2A-2C depict an exemplary liquid displacer 210 disposed within an exemplary LED bulb 200. As described in greater detail below, liquid displacer 210 is configured to displace a predetermined amount of the thermally conductive liquid 110, which reduces the amount of thermally conductive liquid held within shell 130 of LED bulb 200. In the present exemplary embodiment, liquid displacer 210 is depicted as being positioned at the dead zones (as explained above) of LED bulb 200. It should be recognized, however, that the position of liquid displacer 210 within LED bulb 200 is not restricted to the dead zones.

In addition to displacing a predetermined amount of the thermally conductive liquid 110, liquid displacer 210 is configured to facilitate a flow of thermally conductive liquid 110. In particular, as depicted by the arrows in FIG. 2B, liquid displacer 210 directs the flow to follow a cyclical path following an inner radial surface of liquid displacer 210, through an opening and around an outer radial surface of liquid displacer 210. In this manner, LEDs 120 can be cooled using a smaller volume of thermally conductive liquid 110 using liquid displacer 210 than without liquid displacer 210. When the overall density of liquid displayer 210 is lower than the density of liquid 110, reducing the amount of thermally conductive liquid 110 has the advantage of reducing the overall weight of LED bulb 200. Also, reducing the amount of thermally conductive liquid 110 reduces the amount of volume that will need to be compensated for when thermally conductive liquid 110 expands in operation. It should be recognized that the flow of thermally conductive liquid 110 can be a passive convective flow, or can be an active flow.

Liquid displacer 210 may also perform a light-scattering function. For example, liquid displacer 210 may contain scattering particles with a high index of refraction. For example, titanium dioxide, which has an index of refraction exceeding 2.0, may be used. Alternatively, the scattering particles may be suspended in the thermally conductive liquid 110. However, this may limit the thermally conductive liquid 110 to polar liquids only, as non-polar liquids often do not suspend particles well. To the extent that liquid displacer 210 can perform the light-scattering function, the choice of thermally conductive liquid 110 will no longer be restricted to polar liquids, thereby allowing the use of convective liquids that are more inert, or have a larger coefficient of thermal expansion to facilitate passive convective flow.

Liquid displacer 210 may further function as a liquid-volume compensator mechanism to compensate for the volume expansion of the thermally conductive liquid 110 as the temperature rises. For example, liquid displacer 210 may be made of an elastomeric polymer foam containing microscopic air bubbles that do not leak out upon compression. As the thermally conductive liquid 110 heats and expands, liquid displacer 210 may be compressed, since its air bubbles are compressible. The air bubbles may have a dimension close to the wavelength of light, such that the air bubbles may serve as the light-diffusing elements and no additional diffusing materials may be required. As another example, to function as a liquid-volume compensator mechanism, liquid displacer 210 may be bellows made of metal, polymer, or the like. As a further example, liquid displacer 210 may be an elastic bladder made of metal, polymer, or the like.

Liquid displacer 210 may be attached to other components or structures within LED bulb 200. For example, liquid displacer 210 may be attached to shell 130, LED mount 150, and the like. Alternatively, liquid displacer 210 may be suspended in the thermally conductive liquid 110 without being attached to other components or structures.

Liquid displacer 210 may be made of a material with an index of refraction approximately the same as that of the thermally conductive liquid 110, such that any change in the light traveling through the liquid displacer 210 and the thermally conductive liquid 110 is imperceptible to a human, and thus making the liquid displacer 210 appear invisible within the thermally conductive liquid 110. Liquid displacer 210 may be made of rigid materials, such as plastic or polycarbonate, or it may be made of flexible materials, such as a flexible polymer. Liquid displacer 210 is also preferably made of a material that is inert towards the thermally conductive liquid 110 being used.

Figure 3A:
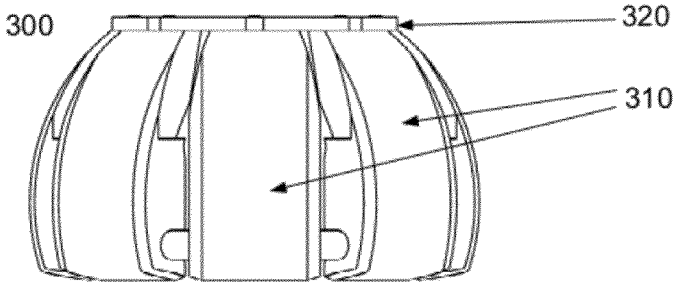
FIGS. 3A-3C depict side, top, and perspective views, respectively, of an exemplary liquid displacer.
Figure 3B:
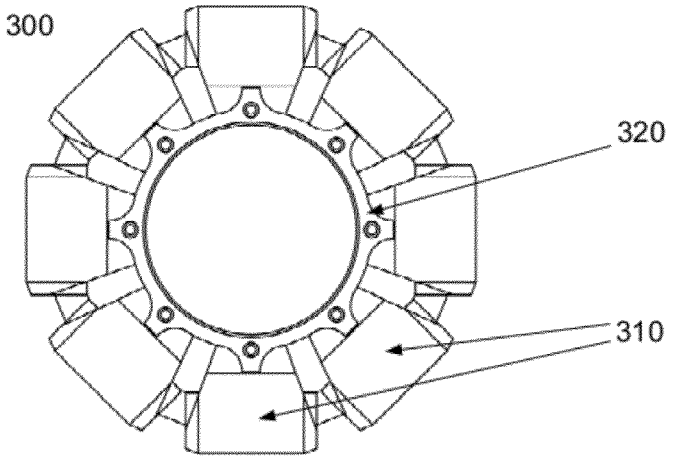
Figure 3C:
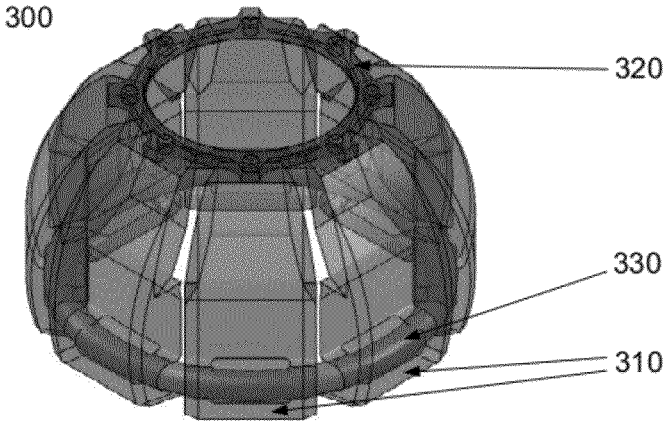

FIGS. 3A-3C depict an exemplary liquid displacer 300 having eight identical displacer segments 310. The eight displayer segments 310 being identical has the advantage of allowing for ease of fabrication and assembly. It should be recognized that a fewer or a greater number of displacer segments 310 may be used. In the present exemplary embodiment, displacer segments 310 are small enough to fit through the small opening of the shell of the LED bulb. Displacer segments 310 can be connected together to form the structure 300 by a small locator ring 320 and a large locator ring 330 placed at the top and bottom of the structure 300, respectively. The small locator ring 320 and the large locator ring 330 may include holes, pins, pegs, and the like, for connecting the displacer segments 310 together.

Figure 4A:
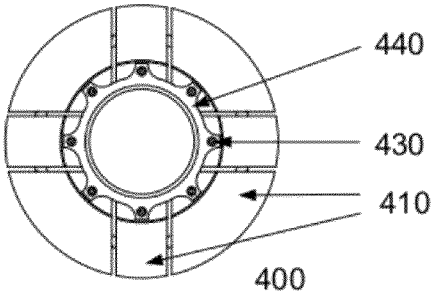
FIGS. 4A-4F depict top, side, bottom, top-perspective, bottom-perspective, and exploded views, respectively, of another exemplary liquid displacer.
Figure 4B:
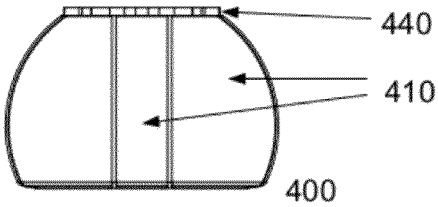
Figure 4C:
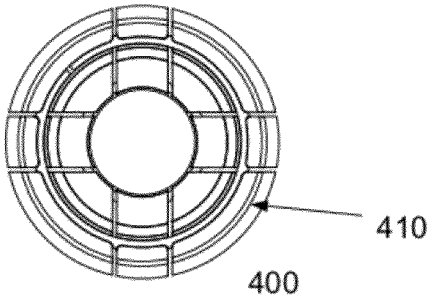
Figure 4D:
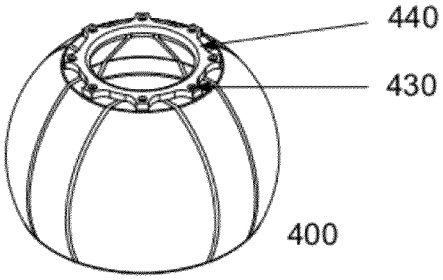
Figure 4E:
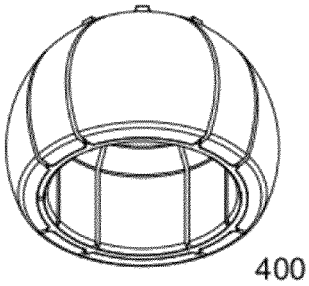
Figure 4F:
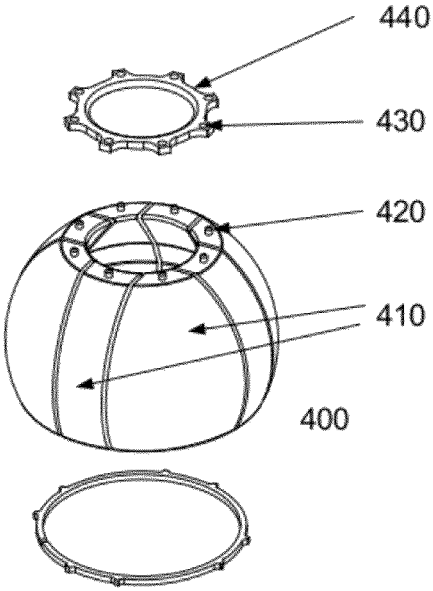
Figure 5A:
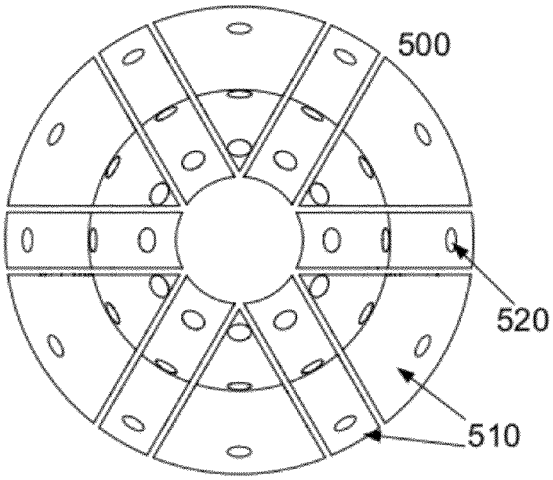
FIGS. 5A-5D depict top, side, cross-sectional, and perspective views, respectively, of another exemplary liquid displacer.
Figure 5B:
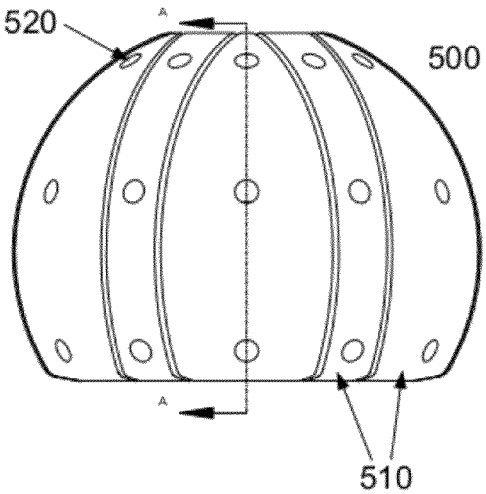
Figure 5C:
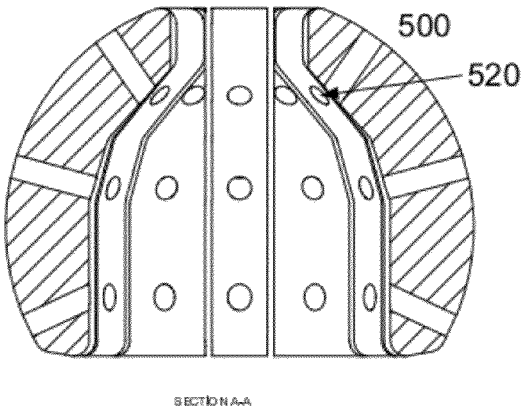
Figure 5D:
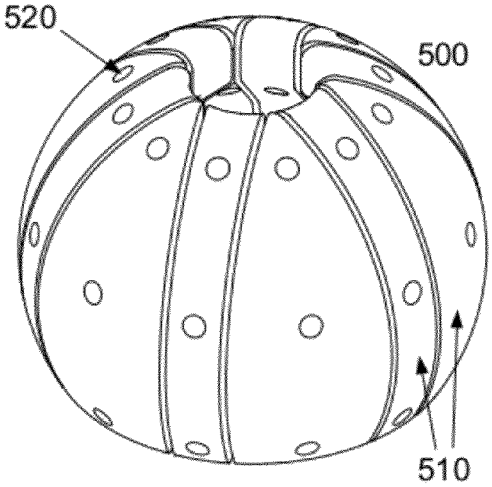
Figure 7:
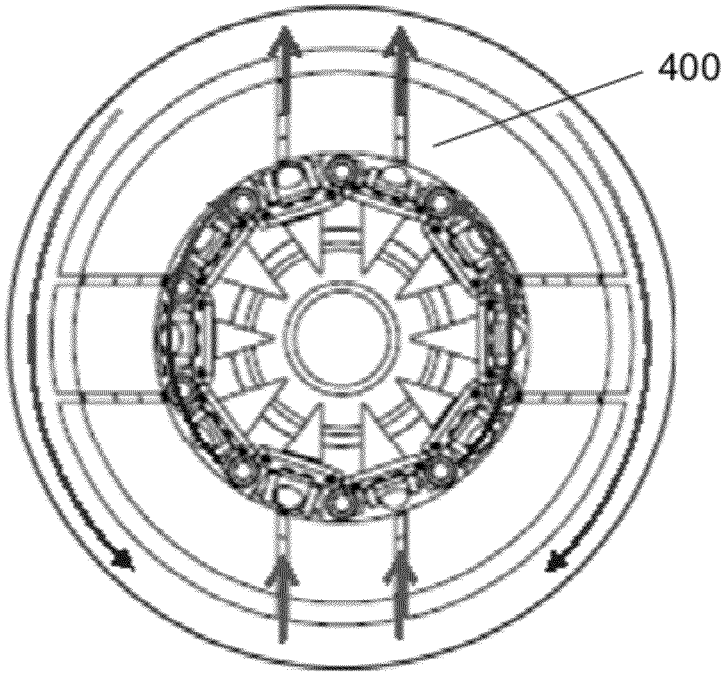
FIG. 7 depicts an exemplary liquid displacer directing the flow of a thermally conductive liquid within an LED bulb.

FIGS. 4A-4F depict another exemplary liquid displacer 400 having eight displacer segments 410, which are not identical in size and/or shape. As shown in FIG. 4F, each of the displacer segments 410 may include a pin 420 that may be fitted through one of the holes 430 on the small locator ring 440 to connect the displacer segments 410 together. FIG. 7 depicts liquid displacer 400 directing the flow of the thermally conductive fluid within the LED bulb, when the LED bulb is positioned in a horizontal orientation.

FIGS. 5A-5D depict yet another exemplary liquid displacer 500 having twelve displacer segments 510. In this exemplary embodiment, displacer segments 510 are also not identical in size and/or shape. Each of the displacer segments 510 may include a plurality of holes 520 to further guide the convective flow of the thermally conductive liquid. Holes 520 can provide the passive convective flow additional cyclical paths circumscribing the inner surface and the outer surface of liquid displacer 500.

Note, liquid displacer 500 can be thermally connected to LEDs 120 (FIG. 1), such as through LED mounts 150 (FIG. 1), to enhance conduction of heat from LEDs 120 (FIG. 1). In particular, the surface area exposure of liquid displacer 500 can enhance convective and conductive heat transfer to thermally conductive liquid 110 (FIG. 1). Also, when liquid displacer 500 functions as LED mounts 150 (FIG. 1), placing LEDs 120 (FIG. 1) in the middle as opposed to the ends of liquid displacer 500 enhances convection cell formation in various bulb orientations.

With reference again to FIGS. 2A-2C, LED bulb 200 may include a connector base 220. The connector base 220 may be configured to fit within and make electrical contact with an electrical socket. The electrical socket may be dimensioned to receive an incandescent, CFL, or other standard light bulb as known in the art. In one exemplary embodiment, the connector base 220 may be a screw-in base including a series of screw threads 260 and a base pin 270. The screw-in base makes electrical contact with the AC power through its screw threads 260 and its base pin 270. However, it should be recognized that the connector base 220 may be any type of connector.

LED bulb 200 may include a heat-spreader base 280. The heat-spreader base 280 may be thermally coupled to one or more of the shell 130, LED mount 150, and the thermally conductive liquid 110, so as to conduct heat generated by the LEDs to the heat-spreader base 280 to be dissipated. The heat-spreader base 280 may be made from any thermally conductive material, such as aluminum, copper, brass, magnesium, zinc, or the like.

Figure 6:
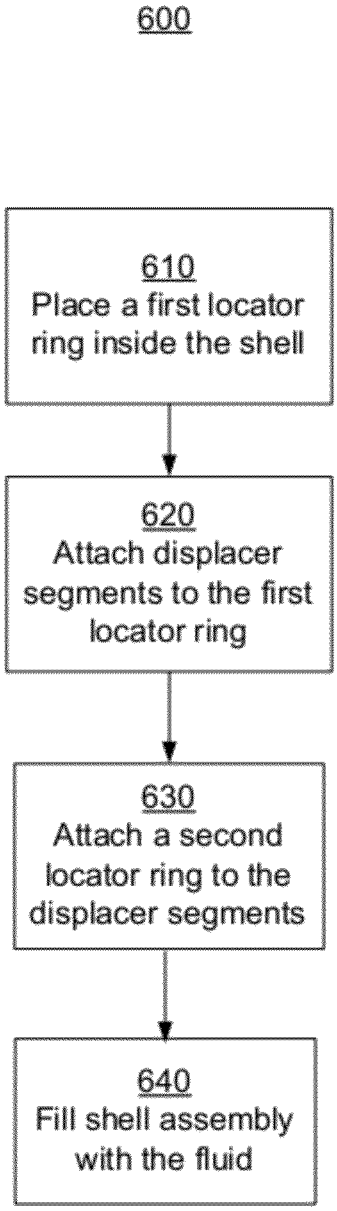
FIG. 6 depicts an exemplary process for making an LED bulb with a liquid displacer.

FIG. 6 illustrates an exemplary process 600 for making an LED bulb with a liquid displacer (e.g., as shown in FIGS. 2A-2C). In this example, the liquid displacer is formed as a plurality of segments. At 610, a first locator ring is placed inside the shell. At 620, the displacer segments are attached to the first locator ring, such that the displacer segments are all connected at the top of the convective liquid displacer. For example, the pins on the displacer segments (or on the small locator ring) may be snapped into the holes on the first locator ring (or on the displacer segments). At 630, a second locator ring, which is larger than the first locator ring, is attached to the displacer segments, such that the displacer segments are all connected at the bottom of the convective liquid displacer. For example, the pins on the displacer segments (or on the second locator ring) may be snapped into the holes on the second locator ring (or on the displacer segments). At 640, the shell together with the liquid displacer inside (the shell assembly) may be filled with thermally conductive liquid. In some examples, no air bubbles should remain in the shell.

It should be recognized that the process 600 described above has been provided by way of example and that other modifications may occur to those skilled in the art without departing from the scope and spirit of the present application. It is contemplated that some of the acts described in process 600 may be performed in slightly different orders or may be performed simultaneously. Some of the acts may be skipped. For example, the exemplary convective liquid displacer 500 as illustrated in FIGS. 5A-5D does not use any locator rings for connecting the displacer segments 510 together. Accordingly, some of the steps in process 600 may be modified or skipped.

Another exemplary process for making an LED bulb with a convective liquid displacer is described below. In this example, the liquid displacer is formed as an integral structure. First, a Teflon® molding tube is placed into the shell as a mold, for forming the liquid displacer around the mold. A polymer mixture that will phase-separate upon baking, i.e., extrude water, shrink, and pull away from both the shell and the Teflon® molding tube, is then poured into the shell but outside the Teflon® molding tube. The shell assembly is then sealed so that water cannot evaporate during a subsequent curing process. The shell assembly is then baked in an oven and then cooled. As a result, the polymer phase-separates, forming a toroidal-shaped gel with a liquid path all around it. The shell assembly is then opened, the water is drained, and the shell assembly is rinsed with a thermally conductive liquid. The Teflon® molding tube is also removed. The shell assembly may be filled with the thermally conductive liquid by immersing the shell assembly in the thermally conductive liquid. Preferably, no air bubbles should remain in the shell assembly. With the shell assembly immersed in the thermally conductive liquid, the LED mount(s) with the LED(s) mounted thereon, the connector base, and other components may be inserted into the hollow center of the polymer structure, assembled, and attached to the shell assembly.

One exemplary embodiment of the polymer mixture that will undergo the desired phase separation may be prepared as described here. First, a 5% aqueous polyvinyl alcohol (PVA) is combined with a 2% aqueous glutaraldehyde in a ratio based on the desired amount of cross-linking between the two. An aqueous suspension of an optical scattering agent may be added for scattering purposes. It should be recognized that the scattering agent should have an index of refraction different from that of the polymer and the convective liquid.

For example, titanium dioxide may be used as a scattering agent. Hydrochloric acid is then added dropwise until the pH of the mixture becomes acidic. The polymer mixture may then be baked overnight at 500 Celsius.

Although only certain exemplary embodiments have been described in detail above, those skilled in the art will readily appreciate that many modifications are possible in the exemplary embodiments without materially departing from the novel teachings and advantages of this invention. For example, the liquid displacer has been depicted having a toroidal shape. It should be recognized, however, that the liquid displacer can have various shapes.

What is claimed is:

1. A light-emitting diode (LED) bulb comprising:
a shell;
at least one LED mount disposed within the shell;
at least one LED attached to the at least one LED mount;
a thermally conductive liquid held within the shell, wherein the LED and LED mount are immersed in the thermally conductive liquid; and
a liquid displacer immersed in the thermally conductive liquid, wherein the liquid displacer is configured to displace a predetermined amount of the thermally conductive liquid to reduce the amount of thermally conductive liquid held within the shell, wherein the liquid displacer is configured to be compressible, wherein the liquid displacer is compressed in response to expansion of the thermally conductive liquid, and wherein the liquid displacer is suspended in the thermally conductive liquid.

2. A light-emitting diode (LED) bulb comprising:
a shell;
at least one LED mount disposed within the shell;
at least one LED attached to the at least one LED mount;
a thermally conductive liquid held within the shell, wherein the LED and LED mount are immersed in the thermally conductive liquid; and
a liquid displacer immersed in the thermally conductive liquid, wherein the liquid displacer is configured to displace a predetermined amount of the thermally conductive liquid to reduce the amount of thermally conductive liquid held within the shell, wherein the liquid displacer is configured to be compressible, wherein the liquid displacer is compressed in response to expansion of the thermally conductive liquid, and wherein the liquid displacer is not attached to other components or structures of the LED bulb.

3. A light-emitting diode (LED) bulb comprising:
a base;
a shell connected to the base;
at least one LED;
a thermally conductive liquid held within the shell, wherein the LED is immersed in the thermally conductive liquid; and
a liquid displacer immersed in the thermally conductive liquid, wherein the liquid displacer is configured to be compressible, wherein the liquid displacer is compressed in response to expansion of the thermally conductive liquid, and wherein the liquid displacer is suspended in the thermally conductive liquid.

4. A light-emitting diode (LED) bulb comprising:
a base;
a shell connected to the base;
at least one LED;
a thermally conductive liquid held within the shell, wherein the LED is immersed in the thermally conductive liquid; and
a liquid displacer immersed in the thermally conductive liquid, wherein the liquid displacer is configured to be compressible, wherein the liquid displacer is compressed in response to expansion of the thermally conductive liquid, and wherein the liquid displacer is not attached to other components or structures of the LED bulb.

5. A light-emitting diode (LED) bulb comprising:
a base;
a shell connected to the base;
a plurality of LEDs arranged in a radial configuration;
a thermally conductive liquid held within the shell, wherein the LEDs are immersed in the thermally conductive liquid; and
a liquid displacer immersed in the thermally conductive liquid, wherein the liquid displacer is configured to be compressible, wherein the liquid displacer is compressed in response to expansion of the thermally conductive liquid, wherein the liquid displacer is an elastic bladder, and wherein the liquid displacer is suspended in the thermally conductive liquid.

6. A light-emitting diode (LED) bulb comprising:
a base;
a shell connected to the base;
a plurality of LEDs arranged in a radial configuration;
a thermally conductive liquid held within the shell, wherein the LEDs are immersed in the thermally conductive liquid; and
a liquid displacer immersed in the thermally conductive liquid, wherein the liquid displacer is configured to be compressible, wherein the liquid displacer is compressed in response to expansion of the thermally conductive liquid, wherein the liquid displacer is an elastic bladder, wherein the liquid displacer is suspended in the thermally conductive liquid, and wherein the liquid displacer is not attached to other components or structures of the LED bulb.

7. A light-emitting diode (LED) bulb comprising:
a base;
a shell connected to the base;
a plurality of LEDs arranged in a radial configuration;
a thermally conductive liquid held within the shell, wherein the LEDs are immersed in the thermally conductive liquid; and
a liquid displacer immersed in the thermally conductive liquid, wherein the liquid displacer is configured to be compressible, wherein the liquid displacer is compressed in response to expansion of the thermally conductive liquid, wherein the liquid displacer is configured as bellows, and wherein the liquid displacer is suspended in the thermally conductive liquid.

8. A light-emitting diode (LED) bulb comprising:
a base;
a shell connected to the base;
a plurality of LEDs arranged in a radial configuration;
a thermally conductive liquid held within the shell, wherein the LEDs are immersed in the thermally conductive liquid; and
a liquid displacer immersed in the thermally conductive liquid, wherein the liquid displacer is configured to be compressible, wherein the liquid displacer is compressed in response to expansion of the thermally conductive liquid, wherein the liquid displacer is configured as bellows, wherein the liquid displacer is suspended in the thermally conductive liquid, and wherein the liquid displacer is not attached to other components or structures of the LED bulb.

* * * * *